US008430486B2

(12) United States Patent
Serizawa et al.

(10) Patent No.: US 8,430,486 B2
(45) Date of Patent: Apr. 30, 2013

(54) INK TANK AND PRINTER WITH THE SAME

(75) Inventors: Kouichi Serizawa, Kawasaki (JP); Masahiro Sakamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 340 days.

(21) Appl. No.: 12/840,786

(22) Filed: Jul. 21, 2010

(65) Prior Publication Data

US 2011/0025790 A1 Feb. 3, 2011

(30) Foreign Application Priority Data

Jul. 31, 2009 (JP) ..... 2009-179465

(51) Int. Cl.
*B41J 2/175* (2006.01)

(52) U.S. Cl.
USPC ..... 347/86

(58) Field of Classification Search .... 347/7; 73/290 R, 73/304 C, 304 R; 340/618, 620
See application file for complete search history.

(56) References Cited

U.S. PATENT DOCUMENTS

| | | | | | |
|---|---|---|---|---|---|
| 4,201,085 | A | * | 5/1980 | Larson | 73/304 C |
| 4,415,886 | A | * | 11/1983 | Kyogoku et al. | 340/618 |
| 4,603,581 | A | * | 8/1986 | Yamanoue et al. | 73/304 C |
| 5,371,529 | A | * | 12/1994 | Eguchi et al. | 347/7 |
| 5,682,184 | A | * | 10/1997 | Stephany et al. | 347/7 |
| 6,474,156 | B1 | * | 11/2002 | Endo et al. | 73/290 V |

FOREIGN PATENT DOCUMENTS

| | | | |
|---|---|---|---|
| JP | 03222755 | * | 10/1991 |
| JP | 8-258281 | | 10/1996 |
| JP | 10286962 | * | 10/1998 |
| JP | 2002-337360 | | 11/2002 |

* cited by examiner

*Primary Examiner* — Ahn T. N. Vo
(74) *Attorney, Agent, or Firm* — Fitzpatrick, Cella, Harper & Scinto

(57) ABSTRACT

Small and large flat electrodes and between which alternating current voltage is applied are touch on respective outer side surfaces of an ink bag of each of main ink tanks to so as to face each other. Surface area (B) of the large electrode is set equal to a surface area of the largest outer side surface of the main ink tank, for example, so as to be much different from surface area (A) of the small electrode. The surface area (A) of the small electrode is set to about one tenth of the surface area (B).

10 Claims, 14 Drawing Sheets

INK TANK AND PRINTER WITH THE SAME

BACKGROUND OF THE INVENTION

1. Field of the Invention

The present invention constitutes main part of a pigment ink agitation system and specifically relates to an ink tank storing pigment ink and a printer with the ink tank.

2. Description of the Related Art

An ink jet printer is equipped with ink containers storing dye ink or pigment ink which is supplied to a printing head. In the case of using an ink container storing pigment ink, the pigment ink is left within the ink container for a long time if the printer does not print for a long time, for example. Since particles as a coloring material (coloring matter) in the components of the pigment ink (hereinafter, referred to as pigment particles) have a specific gravity greater than that of a solvent as another component of the pigment ink, the pigment particles fall down by gravity in the gravity direction within the ink container and settle on the bottom of the ink container. This causes the pigment ink stored in the ink container to have non-uniform concentration of the pigment ink and there is the possibility of inhibiting optimal quality printing with the printing head.

In order to provide a uniform distribution of pigment particles of the pigment ink in an ink containing chamber, for example, an ink jet printer is proposed in which a pair of stirring members stirring the pigment ink are swingably provided in the ink containing chamber. Each of the stirring members is composed of a thin sheet made of a metallic material having a specific gravity greater than that of the pigment ink. The stirring members are configured to swing under the inertia force due to reciprocation of a carriage with the ink container mounted thereon. Namely, the ink container is shaken hard while the carriage is moved from side to side, thus stirring the pigment ink in the ink containing chamber. The pigment particles are thus dispersed so that the concentration distribution of the pigment particles has a uniform distribution in the ink container, thus providing a uniform distribution of the pigment particles of the pigment ink in the ink containing chamber. This results in printing of good images on printing media with the printing head since distribution of the pigment particles of the pigment ink in the ink containing chamber is homogenized.

As shown in Japanese Patent Laid-open No. 2002-337360, another ink jet printer is proposed, which comprises a heater provided to a carriage to heat the bottom of a cartridge for the purpose of stirring ink within the cartridge without complicating the structure of the cartridge. Heating the ink near the bottom of the ink chamber with the heater causes convection of the ink within the ink chamber. The ink within the ink chamber is thus stirred.

Furthermore, a structure for the purpose of stirring magnetic ink in an ink chamber of a cartridge has been proposed as shown in Japanese Patent Laid-open No. 2002-337360, the structure in which magnetic particles in the ink chamber are attracted by magnets provided at right and left ends. That is, when the carriage with the cartridge mounted thereon moves to the left end, the magnetic particles in the ink chamber are attracted by the magnet provided at the left end. On the one hand, when the carriage moves to the right end, the magnetic particles in the ink chamber are attracted by the magnet provided at the right end. Therefore, with such a structure, the magnetic ink in the ink chamber is stirred.

As shown in Japanese Patent Laid-open No. H08-258281 (1996), an ink ejection device has been proposed, in which a rod-like adsorption electrode, a large planer electrode, and an alternating voltage application unit applying alternating current voltage to the electrodes are provided in an ink container. With such a structure, dusts and the like suspended in the ink container, which adversely affect the quality of an image formed on a printing medium and a printing operation of the printing head, are adsorbed and removed.

In such a structure, when alternating voltage is applied between the pair of electrodes having different shapes, the rod-like adsorption electrode adsorbs dusts suspended in the ink and the like. Accordingly, large dusts and the like which will clog the ink ejection portion are removed from the ink, avoiding clogging of an ink filter.

SUMMARY OF THE INVENTION

In the ink jet printer using pigment ink, a means for reciprocating the carriage on which the ink container provided with the stirring members inside is mounted is effective as a means for equalizing the concentration of the pigment ink in the ink container. This is because this means can efficiently stir the pigment ink with the pigment particles settled in the ink container.

However, when the requirement for an ink container having a capacity increased resulting from increasing ink consumption per unit time and the requirement for a weight reduction of the carriage are desired to be fulfilled, this makes it difficult to mount a large capacity ink container on the carriage. Therefore, the ink container needs to be fixed to the body of the ink jet printer and remain unmoved.

In such a case, it is impossible to employ the method of stirring pigment ink in which the heater causing convection of ink in the cartridge is provided on the carriage as shown in Japanese Patent Laid-open No. 2002-337360. It is impossible to employ the method of stirring the pigment ink by moving the carriage provided with the ink container (cartridge). In other words, the ink jet printer requires stirring means capable of stirring pigment ink even in the configuration where the ink container is fixed to the body of the ink jet printer. In this case, for example, a mechanical stirrer may be provided to each ink container. However, this increases the apparatus size and complicates the maintenance thereof, which is therefore not a good idea.

It is possible to employ the ink container as shown in Japanese Patent Laid-open No. H08-258281 (1996) in which alternating voltage is applied between the pair of rod-like adsorption electrodes and the planer electrode so that the adsorption electrode adsorbs pigment particles like dusts and the like. Thus, even if the above configuration is assumed to be employed for stirring pigment ink, the pigment particles are just adsorbed by the rod-like adsorption electrodes and are not stirred. Accordingly, the concentration of pigment ink in the ink container cannot be equalized.

In view of the above-described problem, the present invention aims to provide an ink tank for storing pigment ink and a printer with the ink tank. The ink tank and the printer with the ink tank can stir the pigment ink without outward mechanical vibration or the like performed for the pigment ink in the ink tank.

To achieve the object, an aspect of the present invention is an ink tank which is provided with pigment ink containing pigment particles and a solvent and an ink reservoir storing the pigment ink, the ink tank including: a first electrode disposed on one of side surfaces defining the outside of the ink reservoir; and a second electrode disposed on another one of the side surfaces defining the outside of the ink reservoir opposed to the one outer side surface. The first electrode is thinner than the second electrode so that an electric field strength generated by applying alternating current voltage between the first and second electrodes is higher at the first electrode than at the second electrode. An end of the first electrode is thinner than the other end thereof so that the electric field strength increases from the end of the first electrode toward the other end thereof. Hereby, the pigment particles dielectrically polarized by the alternating current voltage applied between the first and second electrodes move to where the electric field strength is higher.

Another aspect of the present invention is an ink tank which is provided with pigment ink containing pigment particles and a solvent and an ink reservoir storing the pigment ink, the ink tank comprising: a first electrode disposed on one of side surfaces defining the outside of the ink reservoir; and a second electrode disposed on another one of the side surfaces of the ink reservoir opposed to the one side surface defining the outside of the ink reservoir. The first and second electrodes are configured to relatively have such shapes and distance therebetween that a difference between the first and second electrodes in electric field strength generated by applying alternating current voltage between the first and second electrodes is larger in upper part of the ink reservoir in the direction of the gravity than in lower part thereof so that the pigment particles dielectrically polarized by the alternating current voltage applied between the first and second electrodes move against the gravity.

Still another aspect of the present invention is a printer including: an ink tank having pigment ink containing pigment particles and a solvent, an ink reservoir storing the pigment ink, and first and second electrodes disposed respectively on side surfaces of the ink reservoir opposed to each other; and an alternating current voltage application section electrically connecting the first and second electrodes of the ink tank and applying alternating current voltage between the first and second electrodes. The first electrode of the ink tank is thinner than the second electrode and has a width smaller at a first end than at a second end. The first electrode is disposed on one of the side surfaces defining the outside of the ink reservoir while the second electrode is disposed on the other side surface defining the outside of the ink reservoir opposed to the outer side surface. The pigment particles are dielectrically polarized with the alternating current voltage which is applied between the first and second electrodes by the alternating current voltage application section with electric field strength generated at the first electrode with the alternating current voltage which is applied between the first and second electrodes, the electric field strength increasing from the end toward the other end of the first electrode, hereby the pigment particles moving in a direction from the end to the other end of the first electrode in the pigment ink.

With the ink tank storing pigment ink according to the present invention and the printer having the ink tank, pigment particles dielectrically polarized by the alternating current voltage applied between the first and second electrodes move to where the electric field strength is higher, and the pigment ink containing the pigment particles is therefore stirred. Accordingly, it is possible to stir the pigment ink without applying mechanical vibrations or the like to the pigment ink within the ink container.

Further features of the present invention will become apparent from the following description of exemplary embodiments (with reference to the attached drawings).

DESCRIPTION OF THE EMBODIMENTS

Figure 2:
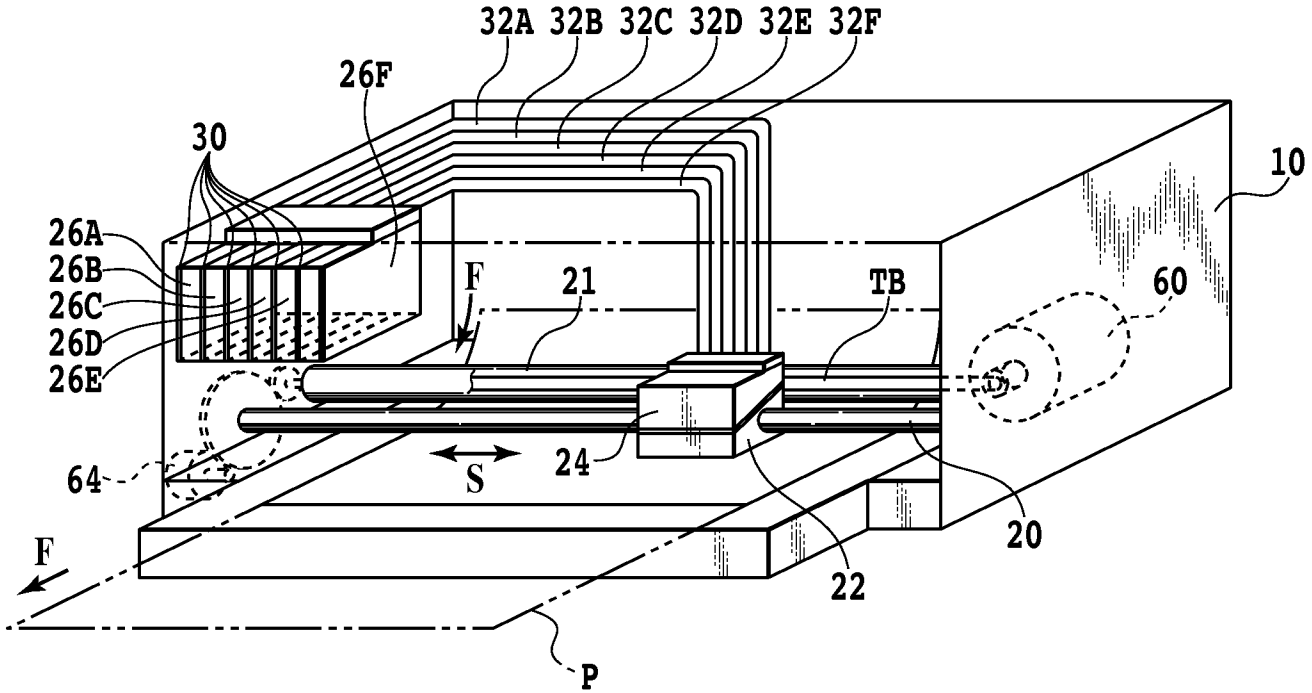
FIG. 2 is a configuration diagram schematically showing a main portion of an ink jet printer as an embodiment of a printer according to the present invention.

FIG. 2 schematically shows a main portion of an ink jet printer including an embodiment of an ink tank according to the present invention constituting a main portion of a pigment ink stirring system as described later. The embodiment of the ink tank according to the present invention may be provided to other ink jet apparatuses, for example, such as multifunction printers, manufacturing apparatuses of electronic devices, and industrial printing apparatuses including textile printing apparatuses.

In FIG. 2, the outline of the apparatus body, which is not shown in the drawing, is composed of an exterior member including a paper catch tray and a chassis 10 accommodated in the exterior member.

The chassis 10 is composed of a plurality of metallic plate members having predetermined rigidity. The chassis 10 constitutes a frame of the ink jet printer and is configured to hold printing operation mechanisms later described.

The printing operation mechanisms accommodated and held in the apparatus body includes an automatic feed section (not shown) and a conveyance section. The automatic feed section is configured to automatically feed printing sheets P as printing media sequentially one by one in a direction indicated by an arrow F.

The conveyance section is configured to introduce the printing sheets P which are fed one by one from the automatic feed section to a predetermined printing position on a platen and introduce the printing sheets P from the printing position to an ejection section.

The printing operation mechanisms further includes a printing section and a recovery section (not shown). The printing section is configured to perform desired printing for the printing sheets P conveyed to the printing position. The recovery section is configured to perform recovery processing for a printing head 28 of the printing section described later.

The aforementioned conveyance section includes a conveyance roller 21 and an ejection roller (not shown). The ejection roller is configured to convey the printing sheets P toward the paper ejection section after the printing sheets P are conveyed by the conveyance roller 21 and are printed.

The conveyance roller 21 is configured to intermittently convey by a predetermined feed amount the printing sheets P fed from the automatic paper feed section one by one. The predetermined feed amount is based on the printing operation of the printing head 28 of the printing section.

The conveyance roller 21 and ejection roller are individually driven with rotational force of a paper feed motor (P. F. motor) 64 transmitted through a gear reduction mechanism and the like. The paper feed motor 64 is supported on one of side portions of the chassis 10. The paper feed motor 64 is driven and controlled by a later-described control block. In such an embodiment, the printing sheets P as the printing media are made of paper, plastic, or the like. In the case of a manufacturing apparatus or a textile printing apparatus including the pigment ink stirring system, the printing sheets P may be glass substrates, textile, or the like.

Printing Section

The printing section includes a carriage 22 and a printing head unit 24 (see FIG. 3) as main elements. The carriage 22 is movably supported on a carriage shaft 20. The printing head unit 24 is detachably mounted on the carriage 22 and includes sub-ink tanks and a printing head 28.

The back of the carriage 22 is connected to a timing belt TB wound around a pair of pulleys. The pulleys are rotatably disposed in the chassis 10 with a predetermined distance therebetween. One of the pulleys is connected to an output shaft of the carriage motor 60. The carriage motor 60 driven and controlled by the later-described control block is activated to allow the carriage 22 to reciprocate in a direction indicated by an arrow S in FIG. 2 above the printing surface of each printing sheet P conveyed onto the not-shown platen.

An end of a flexible printed cable FPC (not shown) is connected to a portion of the carriage 22 at which the printing head unit 24 is not provided. The end of the flexible printed cable FPC is connected to a carriage substrate mounted on the back of the carriage 22. The carriage substrate is a printed circuit board unit mounted on the carriage 22 and functions as an interface for exchanging signals with the printing head 28 through the flexible printed cable FPC. The carriage substrate detects a relative position of an encoder sensor to an encoder scale and outputs the detected position as a detection output signal to the later-described control block through the flexible printed cable FPC. The detection of the relative position of the encoder sensor to the encoder scale is performed based on a pulse signal which is outputted from the encoder sensor as the carriage 22 moves along the encoder scale (not shown). The ends of the encoder scale are supported on respective sides of the chassis 10.

A contact portion at the other end of the flexible printed cable FPC and a contact portion of a wiring substrate provided in the printing head unit 24 are electrically connected. This allows exchange of various types of information for printing, power supply to the printing head 28 of the printing head unit 24, and the like.

Printing Head Unit

The printing head unit 24 used in the printing section includes the sub-ink tanks and the printing head 28. The sub-ink tanks are configured to store respective pigment inks of different colors. The printing head 28 discharges the pigment ink supplied from each sub-ink tank through an ink discharge port according to the printing information from a controller described later.

As shown in FIG. 2, the sub-ink tanks are connected to respective ends of ink supply paths 32A, 32B, 32C, 32D, 32E, and 32F. The other ends of the ink supply paths 32A to 32F are connected to main ink tanks 26A, 26B, 26C, 26D, 26E, and 26F as later-described ink containers, respectively. Each of the main ink tanks 26A to 26F includes an ink storing chamber having a capacity of more than about 40 cc (40 g). The capacity of each sub-ink tank described above is set smaller than that of each main ink tank. The ink supply paths 32A to 32F are each provided with a pump mechanism (not shown) for supplying ink from the main ink tanks to the sub-ink tanks at predetermined time. The present invention is not limited to this embodiment and, for example, the outer shell of each main ink tank may be pressurized to supply pigment ink within the main ink tank to the corresponding sub-ink tank through the corresponding ink supply path according to the pressure thereof.

To implement high photo-quality color printing with the printing head unit 24, the main ink tanks 26A to 26F accommodate, for example, black, light cyan, light magenta, cyan, magenta, and yellow pigment inks, respectively. In other words, the main ink tanks 26A to 26F accommodate respective pigment inks of different colors containing pigment particles with different dielectric polarizabilities.

The printing head 28 provided facing the printing surface PS of each printing sheet P includes a printing element substrate for each ink. The printing head 28 further includes first and second plates, the wiring board, a channel forming member, a filter, a seal rubber, and the like, which are not shown in the drawings.

The printing element substrate is a side shooter type of the bubble jet method (Registered Trademark) which performs printing using an electro-thermal converter. Herein, the electro-thermal converter generates thermal energy causing film boiling in the ink according to an electrical signal. The printing element substrate is composed of a single board. The present invention is not limited to this embodiment, and various methods can be employed including a method using a piezoelectric device, a method using an electrostatic device, and a method using an MEMS device, for example.

Main Ink Tank

Figure 3:
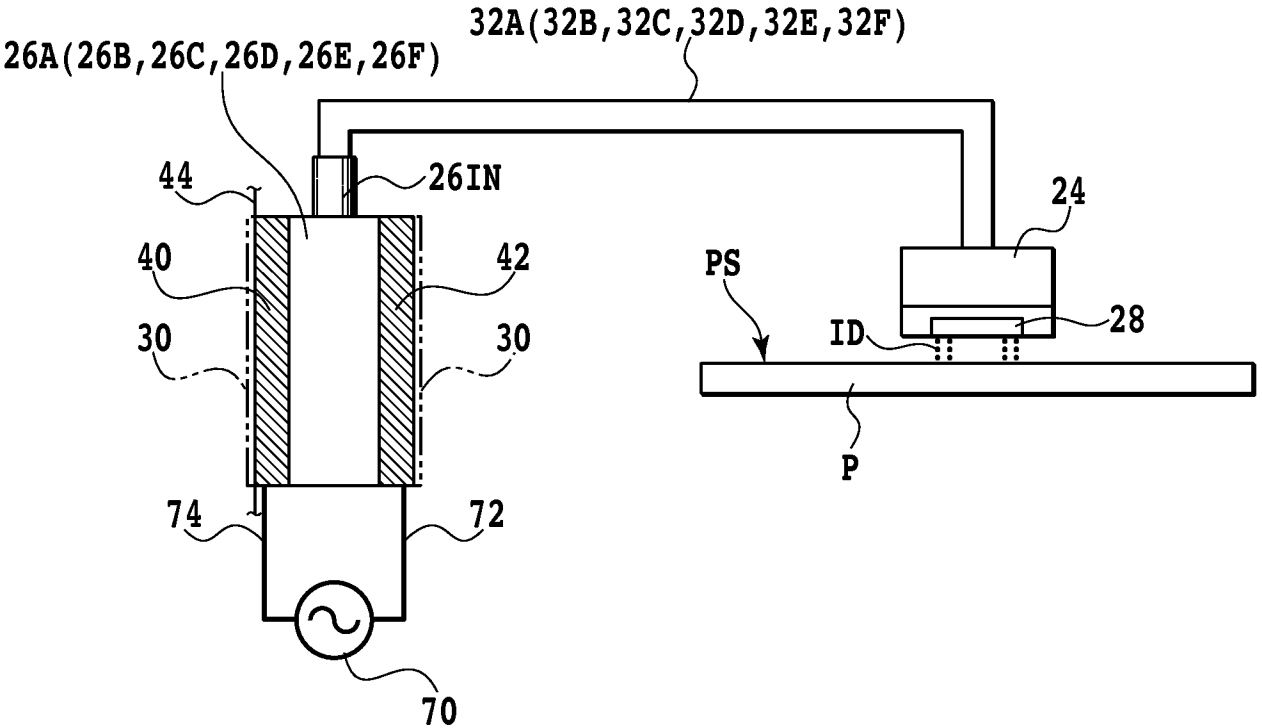
FIG. 3 is a configuration diagram showing the configuration of the embodiment of the ink tank according to the present invention together with a printing head unit and an alternating-current (AC) voltage generator.
Figure 9:
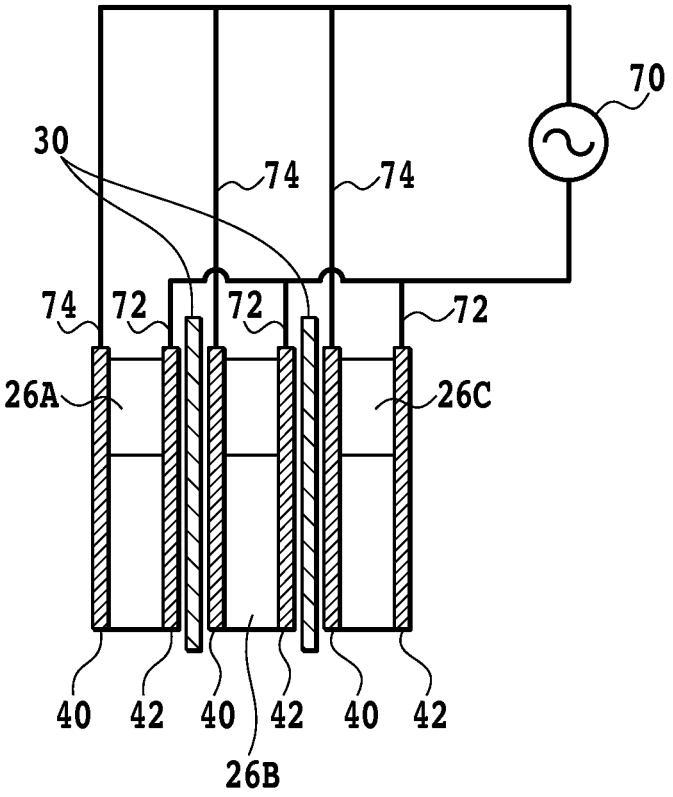
FIG. 9 is a circuit diagram showing an embodiment of a circuit connecting the alternating voltage generator and a plurality of main ink tanks each comprising the small and large electrodes shown in FIG. 1.

Each of the main ink tanks 26A to 26F as the embodiment of the ink tank according to the present invention is fixed to a predetermined position in the chassis 10 as shown in FIG. 2. The pairs of adjacent main ink tanks are blocked from each other by insulating members 30 described later as shown in FIGS. 3 and 9. In FIG. 2, the main ink tanks 26A and 26F at the leftmost and rightmost ends, respectively, are each provided with the insulating members 30 on both sides thereof.

An inner structure of the main ink tanks 26A to 26F have the same inner structure each other. Thus, the description is given of the main ink tank 26A, and the description of the structures of the other main ink tanks 26B to 26F is omitted.

Figure 4:
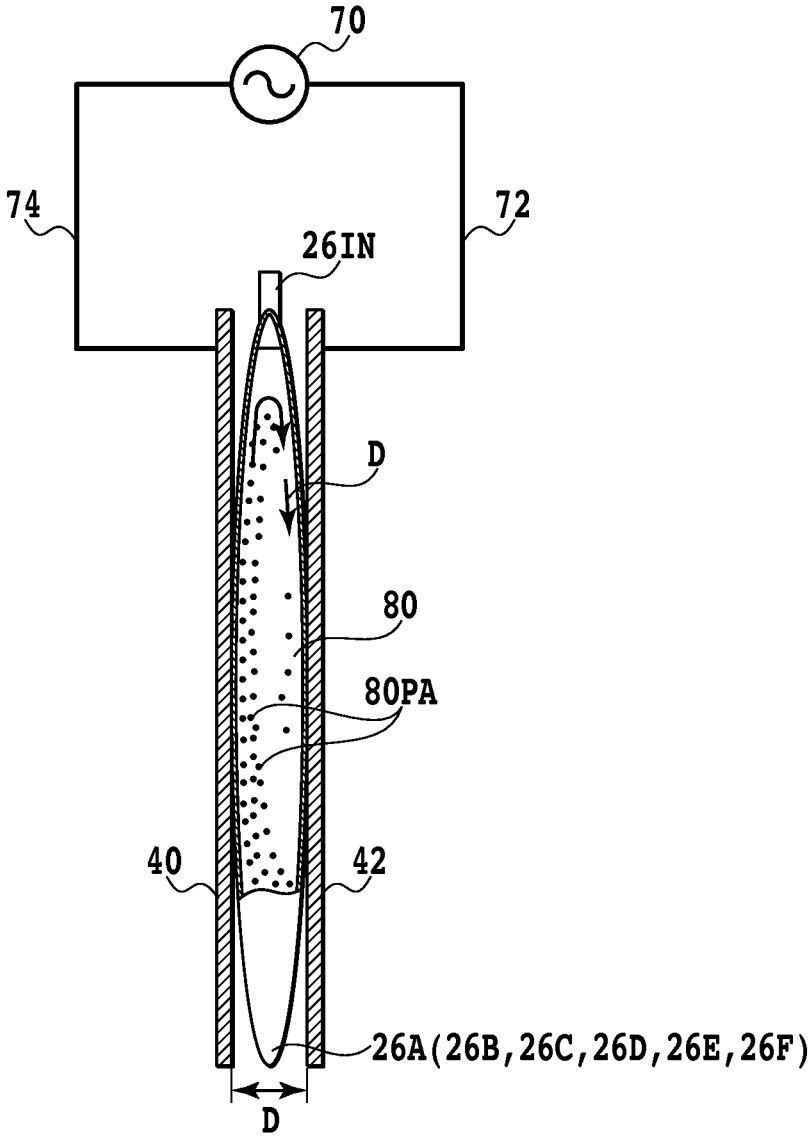
FIG. 4 is a configuration diagram showing a main portion of the configuration of the embodiment of the ink tank according to the present invention together with the alternating voltage generator.

The main ink tank 26A is composed of an ink bag having an ink containing chamber storing a black pigment ink 80, for example, as shown in FIG. 4.

The pigment ink 80 contains, as main components, a solvent and carbon black particles having a diameter of about 0.1 μm as a coloring material (coloring matter) in the components of the pigment ink (hereinafter, also referred to as pigment particles), which are mixed at a predetermined ratio. The solvent is deionized water or water-soluble organic solvent such as methanol, ethanol, and propanol. The pigment ink of each color of the other main ink tanks 26B to 26F contains, as main components, deionized water or water-soluble organic solvent such as methanol, ethanol, and propanol and organic pigment particles as the coloring material of the corresponding color, which are mixed at a predetermined ratio.

Figure 5:
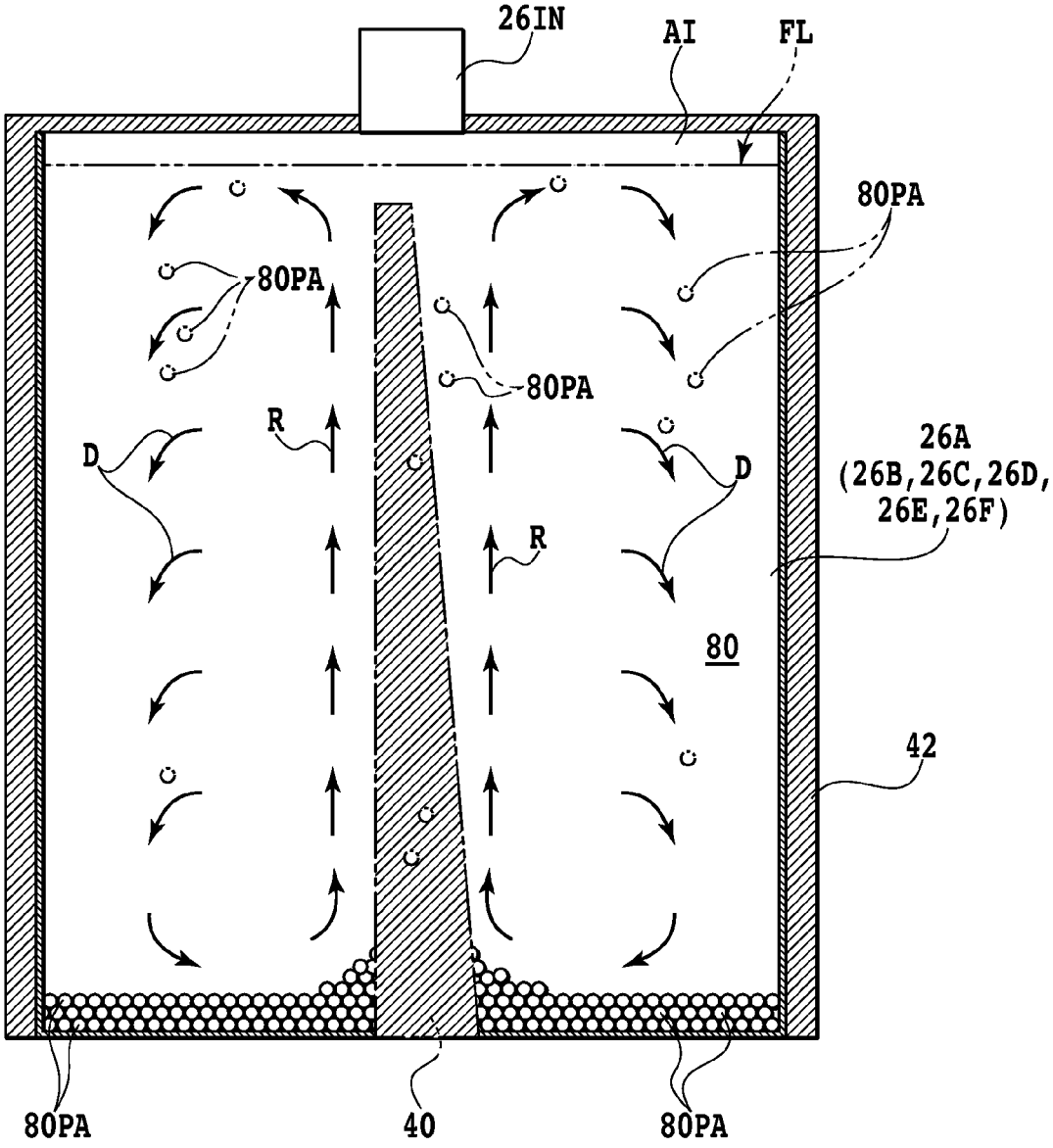
FIG. 5 is a cross-sectional view made available for explanation of an operation of stirring pigment ink in the main ink tank as the embodiment of the ink tank according to the present invention.

The ink containing chamber has a comparatively large inner volume of more than about 40 cc. In the upper center part of the ink containing chamber, an ink supply port 26IN communicating with the inside of the ink containing chamber is provided. As shown in FIG. 5, in the vicinity of the ink supply port 26IN, a fluid level FL of the charged pigment ink 80 is formed in the ink containing chamber. Above the fluid level FL, an air layer AI is formed.

The ink containing chamber may be formed of electrically insulating rubber, vinyl and may be formed of a hard case that is made of electrically insulating plastic, mold, or the like.

Figure 1:
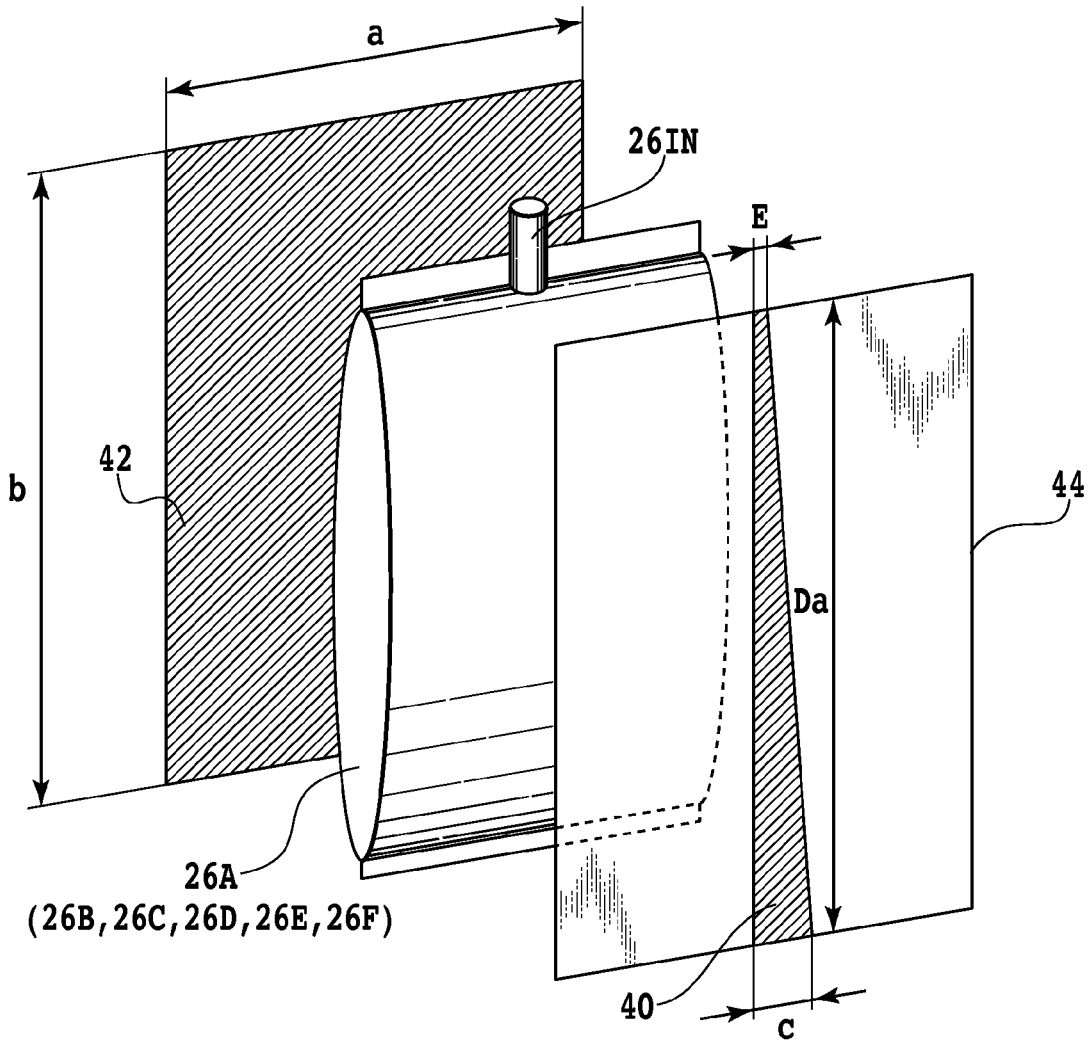
FIG. 1 is a perspective view showing a main ink tank as an embodiment of an ink tank according to the present invention, together with small and large electrodes.

As shown in FIGS. 1 and 3, a thin sheet supporting member 44 to which a small electrode 40 as a later-described first electrode is attached and a large electrode 42 as a second electrode are provided so as to confront each other with the ink bag interposed therebetween. The small electrode 40 is provided between an outer surface of the main ink tank 26A on one side thereof and one of the insulating members 30 while the large electrode 42 is provided between an outer surface of the main ink tank 26A on the other side and another one of the insulating members 30. The flat-shaped small and large electrodes 40 and 42 touch on the respective outer surfaces of the main ink tank 26A.

The small and large electrodes 40 and 42 are electrically insulated from the pigment ink 80. The main ink tank 26A is formed so that the small and large electrodes 40 and 42 will not discharge when the small and large electrodes 40 and 42 are located closest to each other with the main ink tank 26A interposed therebetween.

As shown in FIG. 4, distance D between the small and large electrodes 40 and 42 is set to not more than 1 cm. The thickness of wall of the main ink tank 26A needs to be thin enough to bring the small and large electrodes 40 and 42 and the pigment ink 80 as close to each other as possible. Accordingly, the wall thickness thereof is set to such a value that the small and large electrodes 40 and 42 do not discharge when the small and large electrodes 40 and 42 are located closest to each other as described above and furthermore that the small and large electrodes 40 and 42 are located as close as possible to the pigment ink 80 in the main ink tank 26A. The wall thickness of the ink bag forming the main ink tank 26A is therefore set to a thickness which provides enough strength not to let the pigment ink 80 out but is still not more than about 2.0 mm at maximum.

Each of the small and large electrodes 40 and 42 arranged confronting each other with the main ink tank 26A interposed therebetween are made of a conductor, for example, copper foil, having a thickness of about 0.05 mm.

The supporting member 44 is made of an insulating material, for example, plastic. As shown in FIG. 1, for example, the small electrode 40 has a substantially trapezoidal shape tapered in the direction opposite to the direction of gravity acting on the pigment particles and is stuck to substantially central part of the supporting member 44. Height Da of the small electrode 40 is set equal to the length of the long side of the supporting member 44. Length E of the upper base is set smaller than length C of the lower base. In other words, the width of the small electrode 40 in a direction substantially perpendicular to the direction of gravity acting on the pigment particles 80PA gradually increases in the direction of gravity.

The small electrode 40 is provided on the central part of the supporting member 44, but the present invention is not limited to this embodiment. The small electrode 40 may be stuck to a position a predetermined amount apart from the central axis of the supporting member 44, for example.

In the aforementioned embodiment, a single pair of the small and large electrodes 40 and 42 is provided. The present invention is not limited to this embodiment, and several pairs of electrodes may be provided instead.

In the above embodiment, the small electrode 40 is composed of a single body. However, the present invention is not limited to this embodiment. For example, as shown in FIG. 12, the small electrode stuck to the supporting member 44 may be composed of strip electrodes 46A and 46B each having width smaller than the maximum width of the small electrode 40.

Figure 12:
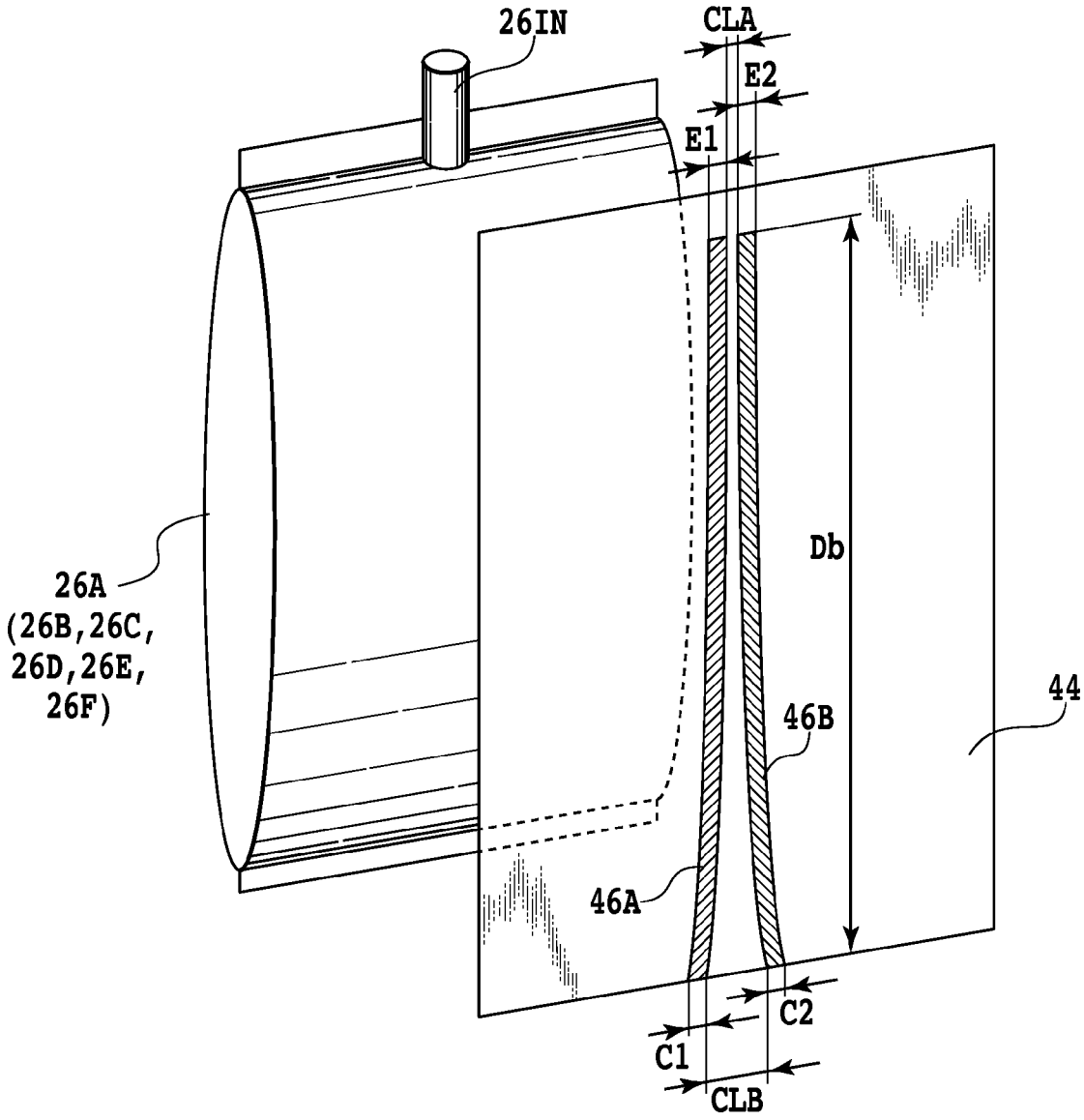
FIG. 12 is a perspective view showing the main ink tank as the embodiment of the ink tank according to the present invention together with another embodiment of the small electrode.

In FIG. 12, the strip electrodes 46A and 46B each having a constant width are formed at positions symmetrical with respect to a central line CL as an axis of symmetry of the supporting member 44 with a predetermined gap therebetween. Height Db of the strip electrodes 46A and 46B is a little less than the length of the long side of the supporting member 44. Widths E1 and C1 of top and bottom ends of the strip electrode 46A are set equal to each other. Widths E2 and C2 of top and bottom ends of the strip electrode 46B, which are set equal to the width E1 of the upper end of the strip electrode 46A, are also set equal to each other. At that time, Minimum distance CLA between the upper ends of the adjacent strip electrodes 46A and 46B is set smaller than maximum distance CLB between the lower ends of the adjacent strip electrodes 46A and 46B. The small electrode composed of the strip electrodes 46A and 46B is thus also tapered, and the width of the small electrode in the direction substantially perpendicular to the direction of gravity acting on the pigment particles 80PA gradually increases in the direction of gravity.

The shape of the small electrode 40 is not limited to a trapezoid. For example, the shape of the small electrode 40 may be composed of a plurality of circular electrodes different in diameter which are aligned on a common line along the long side of the supporting member 44. The shape of the small electrode only should have such a shape that the large and small electric field intensity are distributed over the electric field (electrical field) generated between the small and large electrodes 40 and 42.

That is, the shape of the small electrode may have a wide portion and a thin portion defining a surface area A thereof determined by $\frac{1}{2}(E+C)\times Da$ (see FIG. 1).

The dimensions of the large electrode 42 are set equal to or more than the external dimensions of the main ink tank 26A.

When the ink containing chamber is shaped in a bag, the small and large electrodes 40 and 42 may be directly stuck to the outer surfaces of the main ink tank 26A so as to touch on the respective outer surfaces of the main ink tank 26A opposed to each other. Alternatively, for the purpose of allowing the ink bag to be replaced individually, the large electrode 42 may be fixed to a plastic plate as an electrode fixing plate for fixing the large electrode 42 and then provided so as to indirectly touch on one of the outer surfaces of the main ink tank 26A through the plastic plate.

In this case, when the ink containing chamber is shaped in a bag, in order to implement efficient stirring of the pigment ink 80, the small and large electrodes 40 and 42 touching on the outer surfaces of the main ink tank 26A are provided so that the distance between the small and large electrodes 40 and 42 opposed to each other is minimized at the portion where the area of the small electrode 40 is the largest at the outer surfaces along its length.

Moreover, in order to make the surface area A of the small electrode 40 and a surface area B (=a×b) (see FIG. 1) of the large electrode 42 much different from each other, the surface area B of the large electrode 42 is set equal to, for example, the area of the largest surface of the main ink tank 26A. On the other hand, the surface area A of the small electrode 40 is set to about one tenth of the surface area B (1:10).

Furthermore, as shown in FIGS. 3, 4, and 9, between the small and large electrodes 40 and 42, an alternating voltage generator 70 is connected through conducting wires 72 and 74. A predetermined alternating voltage generated by the alternating voltage generator 70 is applied between the small and large electrodes 40 and 42 at a predetermined timing. The alternating voltage generator 70 is controlled by a switching controller 68 described later.

The alternating voltage applied by the alternating voltage generator 70 is set according to the characteristics of the pigment inks of the main ink tanks 26A to 26F. The applied voltage is set within a range between about one and several kV, and the frequency thereof is about 60 kHz.

Therefore, the pigment ink stirring system comprises the small and large electrodes 40 and 42 provided in each of the main ink tanks 26A to 26F, the alternating voltage generator 70, the switching controller 68, and a central processing unit (CPU) 50 described later.

Figure 10:
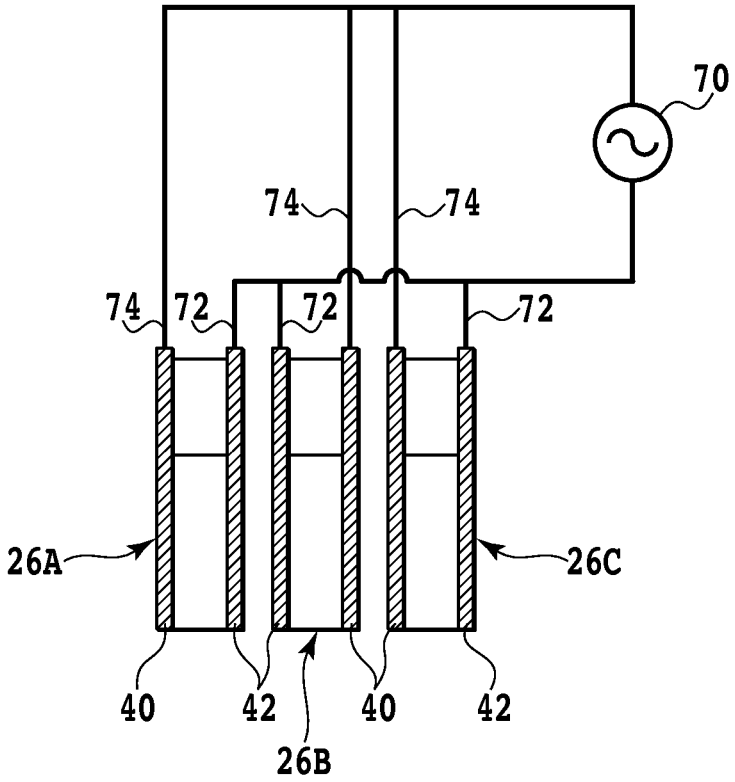
FIG. 10 is a circuit diagram showing another embodiment of a circuit connecting a plurality of main ink tanks each comprising the small and large electrodes shown in FIG. 1 and the alternating voltage generator.
Figure 11:
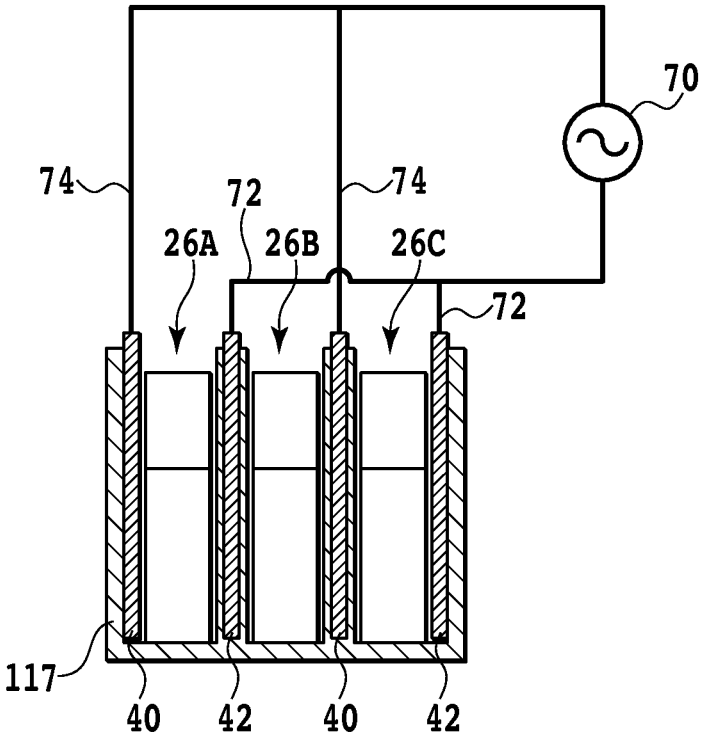
FIG. 11 is a circuit diagram showing still another embodiment of a circuit connecting a plurality of main ink tanks each comprising the small and large electrodes shown in FIG. 1 and the alternating voltage generator.

As shown in FIG. 9, each pair of the small and large electrodes 40 and 42 for applying alternating voltage generated by the alternating voltage generator 70 are provided on both outer sides of the corresponding one of the main ink tanks 26A to 26C as a plurality of ink containers. Between the paired small and large electrodes 40 and 42, the alternating voltage generator 70 is connected through the conducting wires 72 and 74. FIGS. 9 to 11 show only circuits related to the main ink tanks 26A to 26C. Circuits related to the main ink tanks 26D to 26F have the same configuration and are not shown in the drawings.

If alternating voltage is applied to the small electrodes 40 with a polarity shown in FIG. 9, as the electrodes of the ink containers adjacent to each other are subjected to high voltage, and the insulating members 30 as described above are therefore necessary for preventing discharge between these electrodes. In FIG. 9, the electrodes 40 are second electrodes with a small surface area, and the electrodes 42 are first electrodes with a large surface area. In this case, the electrodes having large surface area and the electrodes having small surface area are affected by each other's electric fields because of the small distance therebetween, and a desired distribution of electric field strength cannot be obtained. Accordingly, the aforementioned insulating members 30 need to further have an electric field shielding property.

Therefor, in another embodiment shown in FIG. 10, the same alternating voltage is applied to the adjacent electrodes. Accordingly, the potential difference between the electrodes adjacent to each other is zero, and the insulating members 30 are unnecessary. Moreover, the electrodes adjacent to each other have the same shape (the electrodes having small surface areas are adjacent to each other, and the electrodes having large surface areas are adjacent to each other). This eliminates the mutual influence on the distributions of electric field strength respectively in each adjacent ink containers. Accordingly, the insulating members 30 do not need to have electric field shielding property and the insulating members (an electric field shielding member) 30 can be finally eliminated.

In still another embodiment shown in FIG. 11, the electrodes are not directly provided on the ink containers. The small and large electrodes 40 and 42 are provided in a container holder 117 holding the main ink tanks 26A to 26C (hereinafter, also referred to as ink containers). In this case, each of the plurality of ink containers is accommodated in the corresponding one of a plurality of recesses formed in the container holder 117. The electrodes provided in a container holder 117, i.e. the small electrodes 40 having small surface area and large electrodes 42 having large surface area are provided in partition walls partitioning the recesses and are alternately placed so as to sandwich each ink container accommodated in the corresponding recess. It is therefore understood that even one electrode between the ink containers adjacent to each other functions as a common electrode shared by the ink containers accommodated on both sides of the electrode.

Control Block

Figure 6:
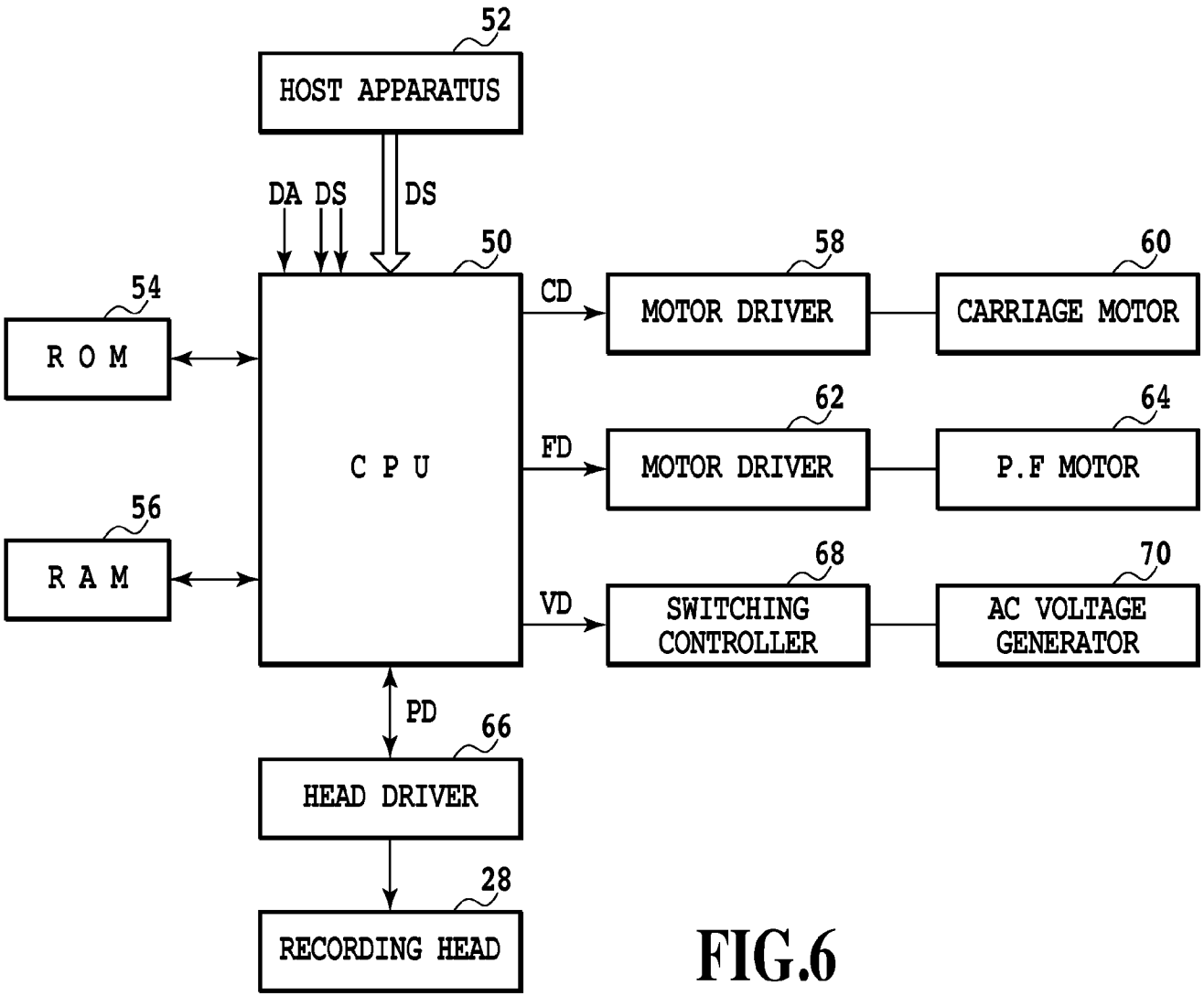
FIG. 6 is a block diagram showing a control block provided in the embodiment of the printer according to the present invention.

As shown in FIG. 6, the ink jet printer includes the control block in addition to the aforementioned configuration. The control block controls the printing operation of the printing head 28, conveyance of the printing sheets P, movement of the carriage 22, and start and stop of the alternating voltage generator 70.

The control block includes a central processing unit (CPU) 50, a read only memory (ROM) 54, and a random access memory (RAM) 56 as main components. The central processing unit (CPU) 50 controls operations of the printing head 28, carriage motor 60, and feed motor 64. The ROM 54 stores program data, and the RAM 56 stores supplied control data, image data, and the like.

The CPU 50 performs the operation control based on the control data supplied from a host apparatus 52 separately provided from the ink jet printer, for example such as personal computer, through a two-way communication section, image data representing an image to be printed, and the like.

The CPU 50 is supplied with, for example, a data group DG including the control data from the host apparatus 52, the image data representing an image to be printed and a detection data group DS supplied from the aforementioned encoder sensor, a sheet end detection sensor, and the like. The CPU 50 is also supplied with other data DA representing an operation start instruction to power on the ink jet printer, instructions for preliminary discharge and suction recovery, and the like.

The CPU 50 is connected to the ROM 54 storing various types of program data and the RAM 56 via a control bus. The RAM 56 includes printing areas corresponding to data of setting values of alternating voltage applied to each main ink tank and time that alternating voltage is applied and printing areas corresponding to the data groups DG and detection data group DS as data buffer for printing. The RAM 56 further includes a printing area as data buffer for controlling each motor.

The CPU 50 performs predetermined image processing based on the data group read from the RAM 56, forms printing operation control data PD, and supplies the printing operation control data PD to a head driver 66 which controls the printing head 28. At that time, the data stored in the RAM 56 is read out by bandwidth in response to a read-out timing signal supplied from the CPU 50 and then the read data is sequentially supplied to the CPU 50 together with various synchronizing signals and clock signals for image processing.

The image processing includes masking data processing, palette conversion for referring to a color conversion data table based on the data and providing color data, and multi-level-to-binary conversion for performing digitization for the obtained color data. The image processing further includes signal distribution processing for distributing digitized signals and registration adjustment.

The head driver 66 forms a printing driving control signal based on the synchronous signal according to the printing operation control data PD and detection data group DG and then supplies the printing driving control signal to the printing head 28. The printing head 28 performs printing operation by discharging ink droplets ID to the printing surfaces PS of the printing sheets P intermittently conveyed based on the printing driving control signal.

The CPU 50 causes the printing head 28 to perform the printing operation and supplies control data CD to the motor driver 58 based on the detection data group DS. The carriage 22 on which the printing head unit 24 is mounted is therefore reciprocated in a direction indicated by the arrow S in FIG. 2 above the printing surfaces of the printing sheets P. The motor driver 58 forms the driving control signal based on the control data CD and supplies the formed driving control signal to the carriage motor 60. When the carriage motor 60 is activated, the carriage 22 is therefore moved each time that the printing surface of printing sheet P is conveyed by a predetermined amount as described later.

The CPU 50 supplies control data FD to the motor driver 62 to convey the printing surface of each printing sheet P by an amount of feed of 1200 dpi, for example, in a direction perpendicular to the direction that the carriage 22 moves, that is in the direction indicated by the arrow F in FIG. 2. The motor driver 62 then forms the driving control signal based on the control data FD and supplies the formed driving control signal to the feed motor 64. When the feed motor 64 is activated, the printing sheet P is therefore fed by a predetermined amount of feed each time that the printing operation of the printing head 28 is finished.

Moreover, on receiving the data DA supplied, the CPU 50 supplies a stirring instruction signal group VD to the switching controller 68 for a predetermined period of time based on data representing power-up of the ink jet printer before the printing operation of the printing head unit 24 starts, for example. The switching controller 68 supplies an application start signal to the alternating voltage generator 70 based on the stirring instruction signal group VD. Hereby, the alternating voltage generator 70 then applies a predetermined alternating voltage set for each of the main ink tanks 26A to 26F between the small and large electrodes 40 and 42 for a predetermined stirring time, for example, about 5 minutes. Thus, the pigment inks in the main ink tanks 26A to 26F are stirred.

Figure 7:
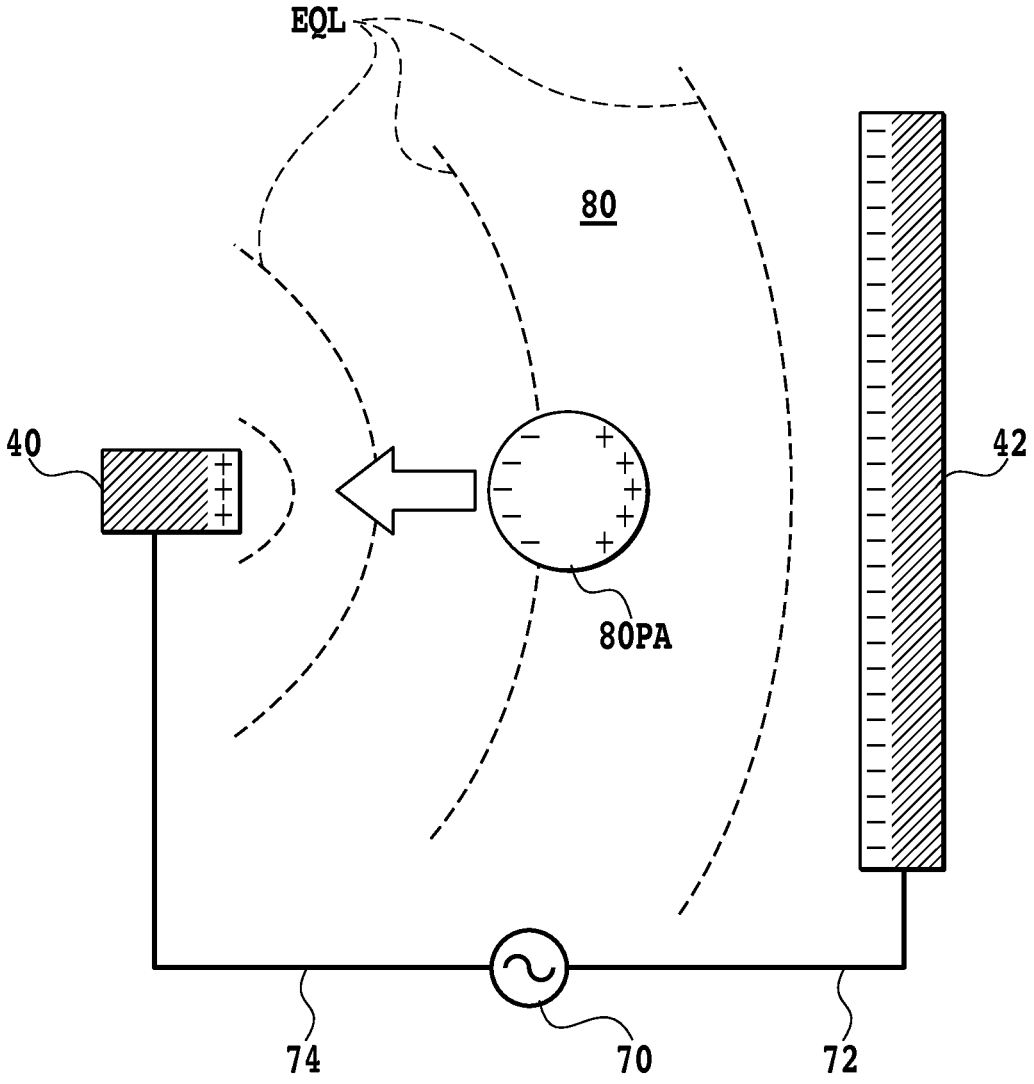
FIG. 7 is an explanatory view made available for explaining the operation of stirring pigment ink in the main ink tank as the embodiment of the ink tank according to the present invention.
Figure 8:
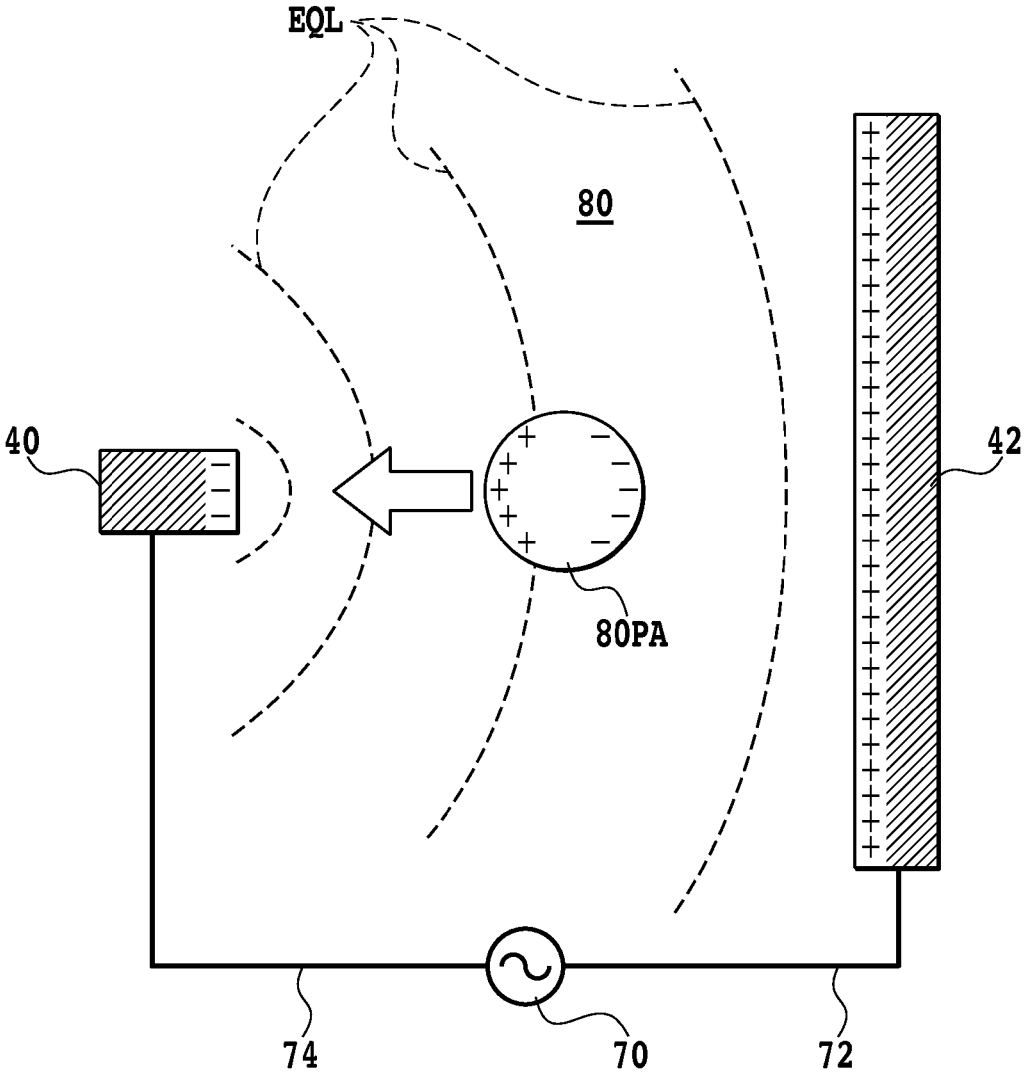
FIG. 8 is an explanatory view for made available explaining the operation of stirring pigment ink in the main ink tank as the embodiment of the ink tank according to the present invention.

When the alternating voltage is applied between the small and large electrodes 40 and 42, as shown in FIGS. 7 and 8, an electric field basically indicated by a plurality of equipotential lines EQL is formed in a cross-section of the pigment ink between the small and large electrodes 40 and 42. At that time, the electric field strength is higher closer to the small electrode 40. At this time, the pigment particles 80PA are subjected to gravity in the direction vertical to the sheet surface.

In this case, as shown in FIG. 7, the pigment particle 80PA existing in the pigment ink 80 (in an electric field with an electric field strength E) is dielectrically polarized. In the pigment particle 80PA, minus charges are collected in part of higher potential while plus charges are collected in part of lower potential. Herein, the absolute values of the plus and minus charges are equal to each other. FIGS. 7 and 8 schematically show dielectric polarization caused in the periphery of the pigment particle 802A including minus or plus charges in the pigment ink 80.

Herein, an electrostatic attractive force F expressed by F=QE is generated, where Q is a charge of the pigment particle 80PA.

In the case of FIG. 7, the small electrode 40 of a plus potential has a surface area smaller than that of the large electrode 42, and thus the electric field strength by the small electrode 40 is higher than that by the large electrode 42 of a minus potential. Accordingly, the pigment particle 80PA dielectrically polarized moves in the direction shown by an arrow, that is, toward the small electrode 40. As shown in FIG. 8, when the alternating voltage becomes negative and the potential is reversed, the pigment particle 80PA is dielectrically polarized so that plus charges appear on the small electrode 40 side and minus charges appear on the large electrode 42 side. Accordingly, the moving direction of the pigment particle 80PA does not change. In other words, the pigment particle 80PA moves in the direction indicated by an arrow, that is, toward the small electrode 40 where the electric field strength E is higher.

As shown in FIGS. 5 and 12, the small electrode 40 has a shape in which the size thereof is large at the bottom side and gradually decreases toward the top side. Accordingly, the tapered portion (top portion) of the small electrode 40 having a small surface area is higher in the electric field strength. In other words, the electric field strength due to the small electrode 40 increases toward the top portion decreasing in width.

As shown in FIGS. 4 and 5, the pigment particles 80PA settled in the bottom of the main ink tank 26A start to rise in a direction indicated by arrows R along the small electrode 40 toward the narrow portion (top portion) of the small electrode 40. At this time, some of the rising pigment particles 80PA are separated away from the small electrode 40 and then fall down at the middle of the ink tank 26A in directions indicated by arrows D or in the direction of gravity.

Most of the pigment particles 80PA in the pigment ink reach the boundary surface of the air layer AI due to the momentum of the rising movement (inertia force), then widely disperse along the boundary surface (in the horizontal direction), and fall down again in the direction of gravity. Such movement of the pigment particles causes convection of the pigment ink indicated by the arrows R and D. As a result, the settled pigment particles 80PA can be stirred in a short period of time.

Figure 13:
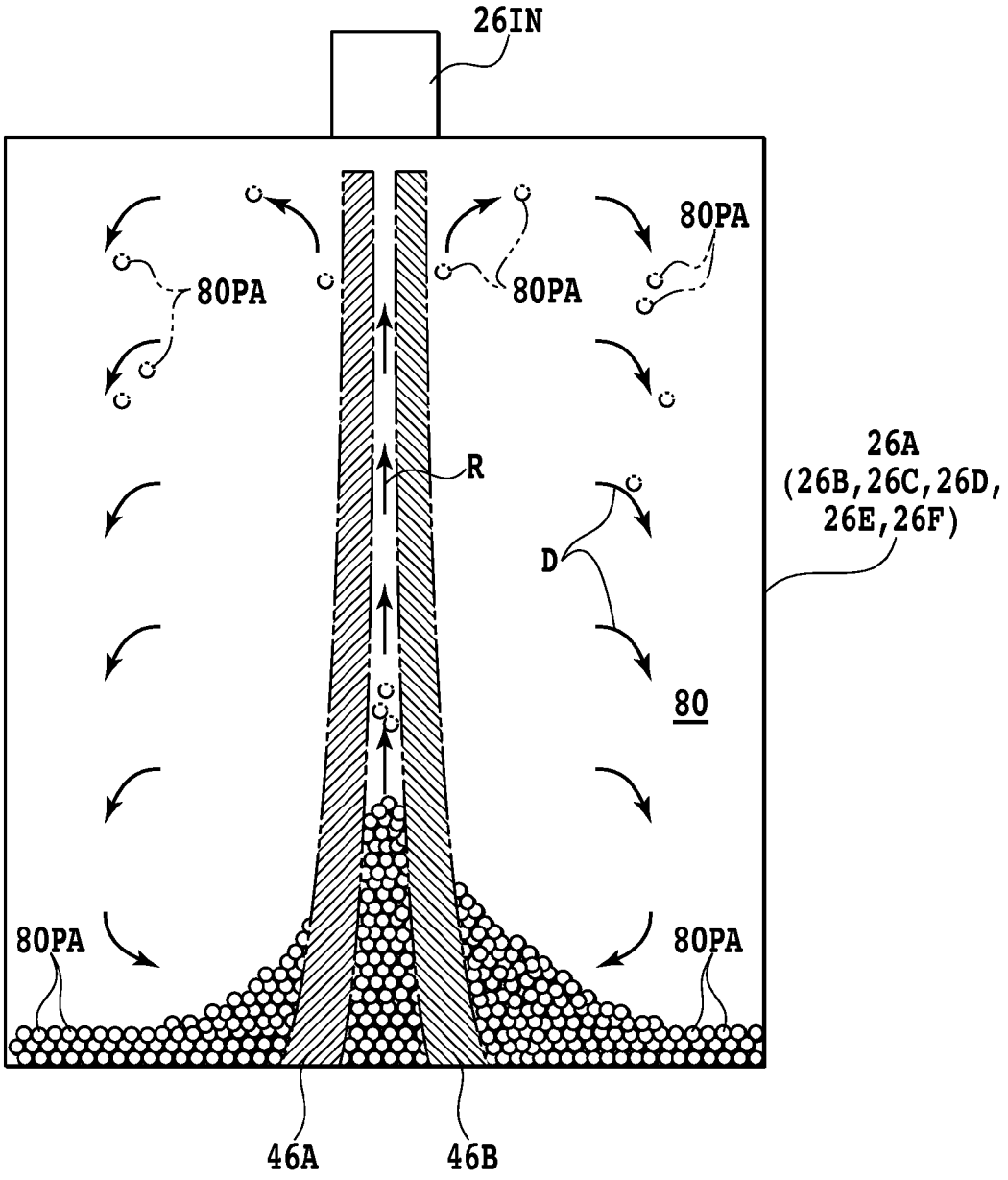
FIG. 13 is a cross-sectional view made available for explaining an operation of stirring pigment ink in the main ink tank provided with the small electrode shown in FIG. 12.

Also in another embodiment shown in FIGS. 12 and 13 described above, the pigment particles 80PA settled in the bottom of the main ink tank 26A start to rise in the direction indicated by arrows R. Namely, as shown in FIG. 13, the pigment particles 80PA start to rise in the direction indicated by the arrows R along the small electrode toward the narrow portion (top portion) of the small electrode where the strip electrodes 46A and 46B are closest to each other. At this time, some of the rising pigment particles 80PA are separated away from the strip electrodes 46A and 46B and then fall down at the middle of the main ink tank 26A in the directions indicated by the arrow D, or in the direction of gravity.

Most of the pigment particles 80PA in the pigment ink reach the boundary surface of the air layer AI due to the energy of the rising movement (inertia force), then widely disperse, and fall down in the direction of gravity. This causes convection of the pigment ink indicated by the arrows R and D. The settled pigment particles 80PA are stirred in a short period of time, thus making the concentration of the pigment ink uniform.

The CPU 50 stops supplying the stirring instruction signal group VD to the switching controller 68 after the elapse of a predetermined time. The switching controller 68 then supplies an application stop signal to the alternating voltage generator 70. Therefore, the alternating voltage generator 70 then stops applying alternating voltage to the main ink tanks 26A to 26F for termination of the stirring.

In the aforementioned embodiment, the particles used to cause convection and stir the pigment ink are the pigment particles 80PA in the pigment ink. However, the present invention is not limited this. In addition to the pigment particles in the pigment ink, for example, stirring particles can be used which are dielectrically polarized at the outer regions and have a possibility of causing a convection as above by applied alternating voltage. Namely, the alternating voltage may be applied to the pigment ink added with a predetermined amount of the stirring particles. The added stirring particles must not to be such particles that cause clogging of the printing head when the ink is ejected.

In the aforementioned embodiment, furthermore, for example, the operation of stirring the pigment ink is performed when the ink jet printer is powered on. However, the present invention is not limited to this. For example, the stirring operation is started using a detection signal from a remaining ink sensor provided in each sub-ink tank. In other words, before the printing operation of the printing head starts, the operation of stirring the pigment ink may be automatically started when it is judged based on the detection signal that the amount of remaining ink is equal to or more than the predetermined amount.

Figure 14:
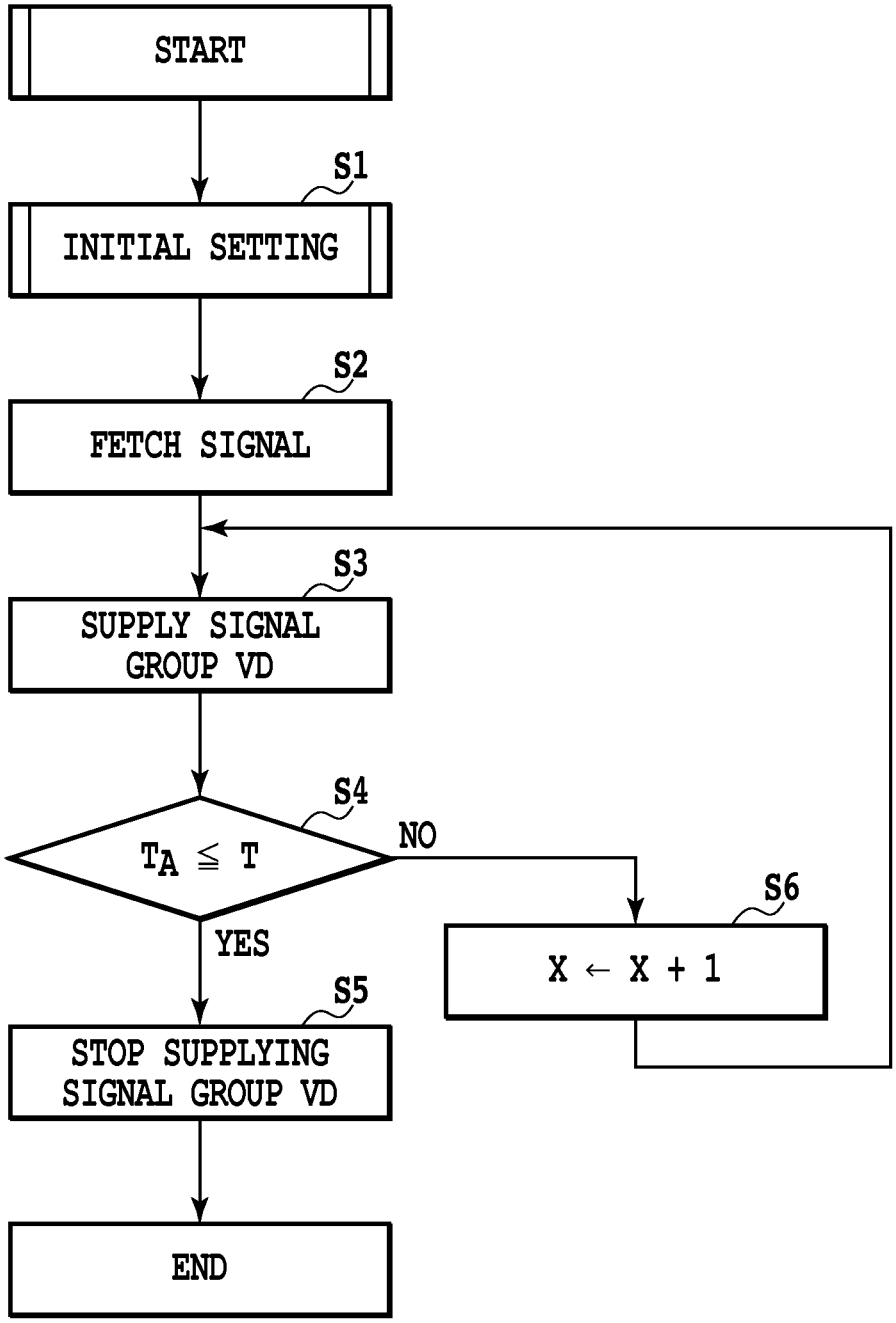
FIG. 14 is a flowchart illustrating an embodiment of a program executed by a microcomputer constituting a central processing unit of the control block, for example.

With reference to the flowchart shown in FIG. 14, description is given of an embodiment of a program executed by the CPU 50 when the CPU 50 of the aforementioned control block is composed of a microcomputer, for example.

In FIG. 19, after the start up, in Step S1, the CPU 50 sets the value of a timer counter to zero and sets the applied voltage and stirring time $T_A$ for each of the main ink tanks 26A to 26F, and proceeds to Step S2. In Step S2, the CPU 50 fetches the signal (data) representing power-up of the ink jet printer, for example. In subsequent Step S3, the CPU 50 supplies the stirring instruction signal group VD to the switching controller 68 and proceeds to Step S4. In Step S4, the CPU 50 determines whether stirring time T corresponding to the timer counter value X is equal to or more than the predetermined stirring time $T_A$. If the stirring time T is equal to or more than the predetermined stirring time $T_A$ in Step S4, the CPU 50 stops supplying the stirring instruction signal group VD and terminates the program in subsequent Step S5.

On the other hand, if the stirring time T is less than the predetermined stirring time $T_A$ in Step S4, the CPU 50 increments the timer counter value X by 1 and returns to Step S3. The CPU 50 then executes the subsequent steps in the same way as described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-179465, filed Jul. 31, 2009, which is hereby incorporated by reference herein in its entirety.

What is claimed is:

1. An ink tank which is provided with pigment ink containing pigment particles and a solvent and an ink reservoir storing the pigment ink, the ink tank comprising:

a first electrode disposed on one of side surfaces defining the outside of the ink reservoir; and a second electrode disposed on another one of the side surfaces of the ink reservoir opposed to the one side surface defining the outside of the ink reservoir, wherein said first electrode is thinner than said second electrode so that an electric field strength generated by applying alternating current voltage between said first and second electrodes is higher at said first electrode than at said second electrode, an end of said first electrode is thinner than the other end thereof so that the electric field strength increases from the end of said first electrode toward the other end thereof, and hereby, the pigment particles dielectrically polarized by the alternating current voltage applied between said first and second electrodes move to where the electric field strength is higher.

2. The ink tank as claimed in claim 1, wherein the ink tank is tapered upward in the direction of gravity so that the pigment particles settled down in the direction of gravity move upward in the direction of gravity.

3. An ink tank which is provided with pigment ink containing pigment particles and a solvent and an ink reservoir storing the pigment ink, the ink tank comprising:

a first electrode disposed on one of side surfaces defining the outside of the ink reservoir; and a second electrode disposed on another one of the side surfaces of the ink reservoir opposed to the one side surface defining the outside of the ink reservoir, wherein said first and second electrodes are configured to relatively have such shapes and distance therebetween that a difference between said first and second electrodes in electric field strength generated by applying alternating current voltage between said first and second electrodes is larger in upper part of the ink reservoir in the direction of the gravity than in lower part thereof so that the pigment particles dielectrically polarized by the alternating current voltage applied between said first and second electrodes move against the gravity.

4. The ink tank as claimed in claim 3, wherein said first electrode is thinner than said second electrode and has electrode width smaller in upper part than in lower part in the direction of gravity.

5. A printer comprising:

an ink tank having pigment ink containing pigment particles and a solvent, an ink reservoir storing the pigment ink, and first and second electrodes disposed respectively on side surfaces of the ink reservoir opposed to each other; and an alternating current voltage application section electrically connecting the first and second electrodes of the ink tank and applying alternating current voltage between the first and second electrodes, wherein the first electrode of the ink tank is thinner than the second electrode and has a width smaller at a first end than at a second end, the first electrode disposed on one of the side surfaces defining the outside of the ink reservoir while the second electrode is disposed on the other side surface defining the outside of the ink reservoir opposed to the outer side surface, and the pigment particles are dielectrically polarized with the alternating current voltage which is applied between the first and second electrodes by the alternating current voltage application section with electric field strength generated at the first electrode with the alternating current voltage which is applied between the first and second electrodes, the electric field strength increasing from the end toward the other end of the first electrode, hereby the pigment particles moving in a direction from the end to the other end of the first electrode in the pigment ink.

6. The printer as claimed in claim 5, wherein the ink tank is mounted on the printer in such a manner that the first end of the first electrode, which is thinner than the second end, is set above the second end thereof in the direction of gravity, and pigment particles settled down in the direction of gravity are moved upward in the direction of gravity with the alternating current voltage applied between the first and second electrodes by the alternating voltage application section.

7. The printer as claimed in claim 5, wherein said printer is provided with a plurality of the ink tanks which are mounted side by side with insulating layers interposed therebetween and different voltages are applied respectively to each adjacent pair of the electrodes.

8. The printer as claimed in claim 5, wherein the printer is provided with a plurality of the ink tanks which are mounted side by side and same voltage is applied to each adjacent pair of the electrodes.

9. The printer as claimed in claim 5, wherein said printer is provided with a plurality of the ink tanks which are mounted side by side and the electrodes provided between the adjacent ink tanks among the electrodes disposed on the outside of the plurality of ink tanks serve as common electrodes.

10. The printer as claimed in claim 5, wherein said printer is provided with a plurality of the ink tanks which are mounted side by side and each adjacent pair of the electrodes disposed on the outside of the plurality of ink tanks have a same shape.

* * * * *